United States Patent [19]

Morris

[11] 4,417,849

[45] Nov. 29, 1983

[54] VARIABLE GEOMETRY CENTRIFUGAL PUMP

[75] Inventor: Joseph H. Morris, Queenstown, Md.

[73] Assignee: The United States of America as represented by the Secretary of the Navy, Washington, D.C.

[21] Appl. No.: 302,343

[22] Filed: Sep. 15, 1981

[51] Int. Cl.[3] ..... F01D 7/00

[52] U.S. Cl. ..... 415/131; 415/140; 415/26; 415/34; 192/85 A

[58] Field of Search ..... 416/133; 415/131, 140, 415/34, 26, 132, 65; 192/58 C, 88 A, 67 R, 85 A; 188/166; 267/150, 161, 162, 158

[56] References Cited

U.S. PATENT DOCUMENTS

| | | | |
|---|---|---|---|
| 2,090,401 | 8/1937 | Mayo | 192/85 A X |
| 2,358,744 | 9/1944 | Stepanoff | 415/140 X |
| 2,534,123 | 12/1950 | Hasselhorn | 267/162 X |
| 2,713,482 | 7/1955 | Stapleton | 267/162 |
| 3,918,831 | 11/1975 | Grennan | 415/131 |

FOREIGN PATENT DOCUMENTS

| | | | |
|---|---|---|---|
| 2049832 | 12/1980 | United Kingdom | 415/131 |

*Primary Examiner*—Harvey C. Hornsby
*Assistant Examiner*—Shewen Bian
*Attorney, Agent, or Firm*—R. F. Beers; L. A. Marsh

[57] ABSTRACT

A variable breadth centrifugal pump arrangement includes two intermeshing impeller sections that are mounted to a common pump shaft so that one of the impeller sections is axially moveable relative to the other impeller section. The impeller sections are rotationally interconnected by a torque transmitting member in the form of a bellows element, which may comprise an axially resilient metal tube formed with a plurality of pleats or a plurality of radially spaced pleated metal tubes that are separated by elastomeric material. Another form of torque transmitting bellows element comprises a plurality of dish-shaped element connected together at their central and peripheral edge portions.

8 Claims, 12 Drawing Figures

VARIABLE GEOMETRY CENTRIFUGAL PUMP

BACKGROUND OF THE INVENTION

This invention generally relates to variable capacity pumps and, more particularly, to centrifugal pumps with impeller sections which are axially adjustable to vary the pump flow rate.

Centrifugal pumps are normally designed to operate at high efficiency over a predetermined operating range with a reduction in pump efficiency occurring as such pumps deviate from the design flow conditions. For example, a reduction in pump efficiency due to partial loading often becomes acute at relatively low flow demands with attendant internal recirculation of pump fluid, pump overheating, fluid pressure pulsations, and undesirable hydraulic noise. Attempts to produce a pumping system that can efficiently and quietly vary its flow and pressure characteristics to match varying system demands have included plural pump arrangements, pump throttling and bypass techniques, and utilization of variable geometry pumps. One form of variable flow centrifugal pump includes axially adjustable impeller sections for varying the flow rate of the pump, as exemplified, for example, by U.S. Pat. Nos. 3,407,740; 3,771,927; 3,806,278; 3,901,623; 3,918,831; and 4,070,132. In these pumps, the impeller sections are keyed to the rotor shaft with various spline means so that relative rotational displacement of the impeller sections is precluded as the axial spacing between adjacent impellers is increased. However, axial movement of the impeller sections while under load often results in high friction and related wear problems. Since the tolerances between different parts of the pump are normally quite critical to ensure high pump efficiency, abrasive wearing of various elements of this type of pump structure results in erratic operation of the impeller parts, decreasing pump efficiency, increased maintenance costs, and production of undesirable hydraulic noise.

SUMMARY OF THE INVENTION

The present invention overcomes frictional wear and efficiency problems encountered with prior art pump arrangements by providing a durable centrifugal pump construction which is capable of high operating efficiency for extended periods of time at variable flow rates. This is accomplished by constructing the variable breadth centrifugal pump of two adjacent intermeshing impeller sections mounted to a common pump shaft, wherein one of the impeller sections is mounted in a fixed axial position on the shaft and the other impeller section is positioned for axial displacement along the shaft. A flexible torque transmitting means extends between the stationary impeller section and the axially moveable impeller section for transmitting torque forces therebetween, thereby imparting rotational movement to the axially displaceable impeller. The torque transmitting means is constructed to undergo intermittent axial contraction and elongation as the impellers respectively close together and draw apart. A spring means can be connected to the impellers to biase the impellers apart, thus requiring a predetermined fluid pressure to bring the impellers together a preselected amount.

According to one embodiment of the invention, the torque transmitting means comprises an axially resilient bellows formed of a tube of steel, copper alloy, stiff plastic material or other like material that is provided with a plurality of regularly spaced pleats. A second torque transmitting means comprises inner and outer bellows members of metal or plastic that are separated by a layer of elastomeric material. Another torque transmitting means comprises a plurality of concave metallic elements which are connected together in opposing relationship to form an elongated bellows having an internal spring constant. A further torque transmitting arrangement comprises an elastomeric layer disposed between two coaxial bellows elements, wherein the convoluted grooves and ridges of the bellows elements are radially aligned to permit axial deformation thereof.

Accordingly, an object of the present invention is to provide a variable performance pump whose operating characteristics can be varied over a wide range to obtain constant head, constant capacity or other desired pumping characteristics.

Another object of this invention is the provision of a centrifugal pump having impeller sections which are axially adjustable for varying the flow rate of the pump during operation.

A further object of this invention is the provision of a centrifugal pump construction characterized by novel features and relatively few parts so that it is both easy and economical to manufacture and repair.

Still another object of the present invention is to provide a novel torque transmitting means designed to accomodate axial displacements without adverse wear problems.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may be best understood by reference to the following description taken in connection with the accompanying drawings, in which:

FIGS. 6–9are enlarged sectional views of other torque transmitting elements which are similar to the arrangement in FIG. 4;

DETAILED DESCRIPTION OF THE PREFERRED EMBODIMENTS

Figure 1:
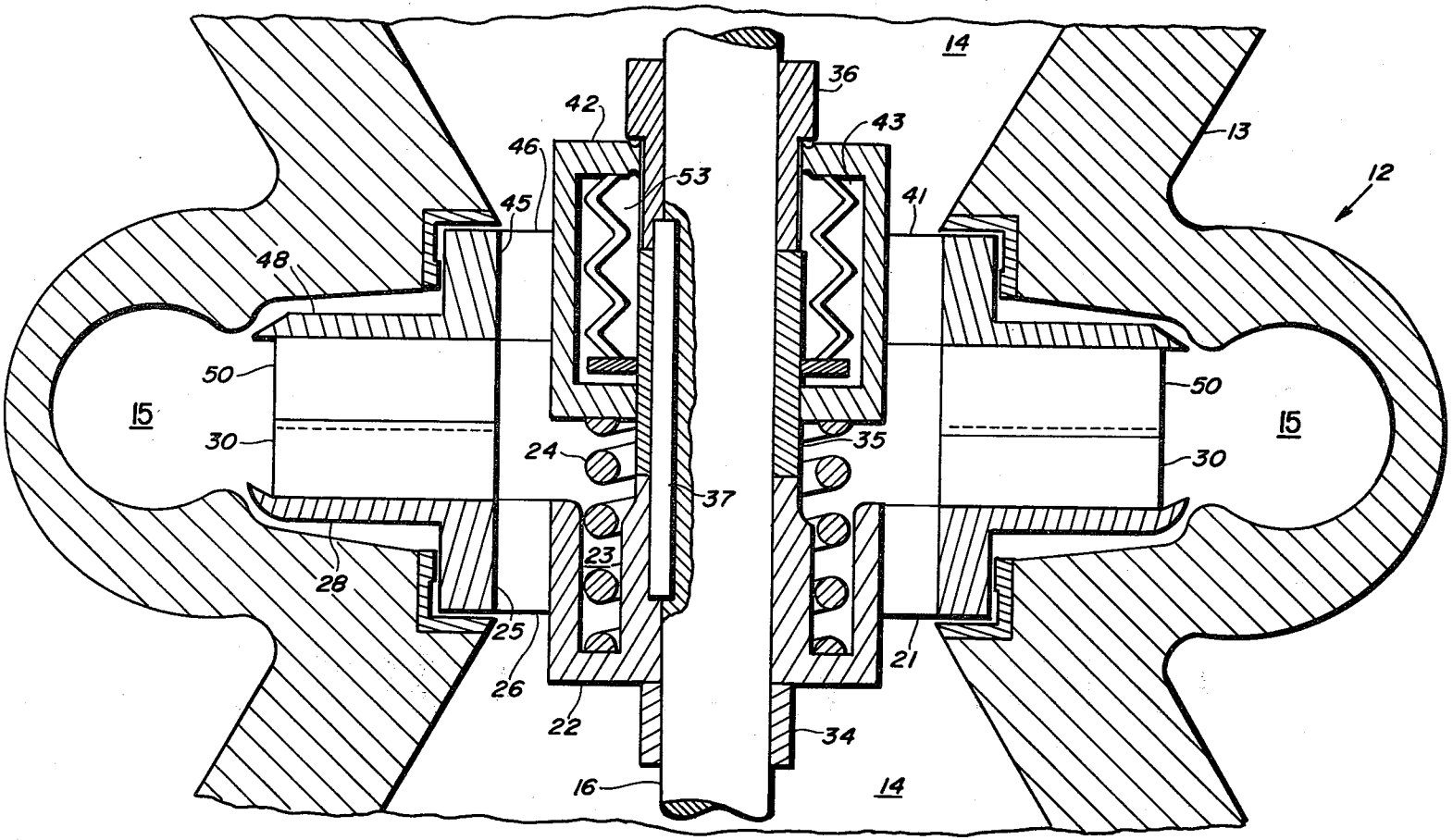
FIG. 1 is a sectional view of a centrifugal pump with a variable geometry impeller unit according to this invention.

Referring now to the drawings and to FIG. 1 in particular, there is shown a sectional view of a pump structure 12 generally comprising a variable breadth impeller assembly mounted within a housing 13 for conveying fluid radially outwardly from the housing inlets 14 to a toroidal collector region 15 connected to the outlet of the housing. The impeller assembly generally consists of an axially stationary impeller 21, which is rotationally keyed to the pump drive shaft 16, and an axially movable impeller 41, which is connected to the stationary impeller 21 through a torque transmitting means 53 so that the impellers rotate in unison.

Figure 2B:
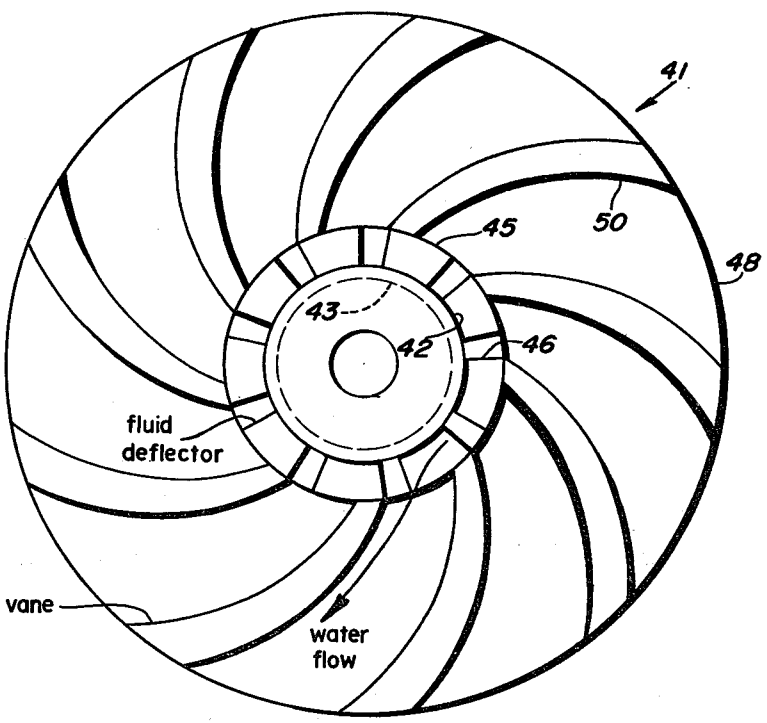
FIG. 2B is a plan view of an axially displaceable impeller designed to intermesh with the impeller structure of FIG. 2A.
Figure 2A:
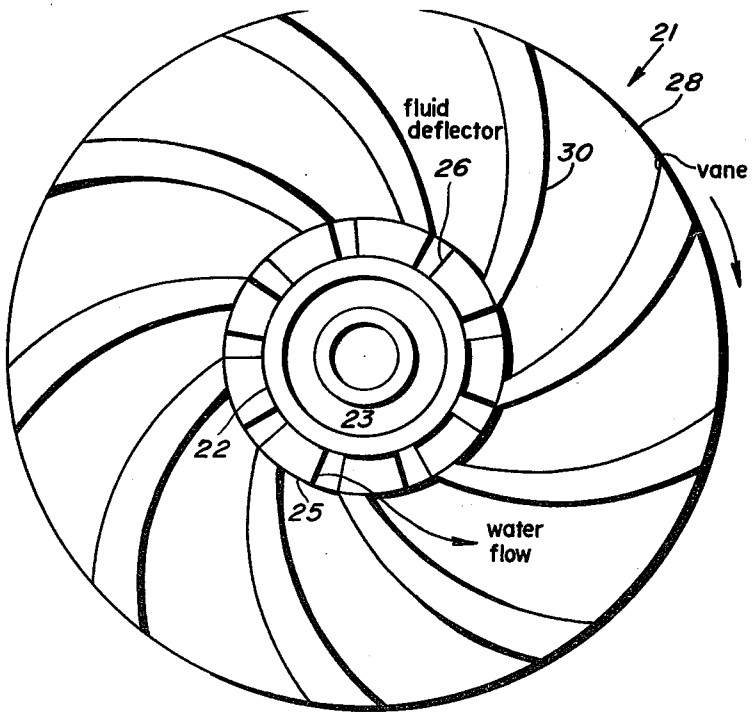
FIG. 2A is a plan view of a stationary impeller used in the type of pump shown in FIG. 1.

The axially stationary impeller 21, as shown in FIGS. 1 and 2A, is positioned on shaft 16 by spaced shaft sleeves 34,35,36 and rotationally keyed to the shaft with a spline or shaft key 37. Impeller 21 is provided with a cylindrical hub portion 22 which encircles pump shaft 16; a radial outer portion 28 which contains impeller vanes 30; and an intermediate portion 25 which contains fluid directing deflectors 26 for conveying fluid from housing inlet 14 to impeller vanes 30. The hub portion 22 includes a circumferential cavity 23 for receiving a spring element 24 that is used to bias the impeller sections apart. To prevent undesirable friction and wear problems between spring element 24 and impeller sections 21,41, the spring element may be coated with friction reducing coating materials and the end portions of the spring element may be fixed to the impeller sections. Impeller vanes 30, whose shape is preferably spirally curved (but which can be any other typical impeller shape such as straight out from the hub or axially offset from the hub), are designed to provide a close clearance with impeller vanes 50 on opposing the impeller section 41, as shown in FIG. 3.

Sleeve sections 34,35,36, which prevent axial displacement of stationary impeller section 21, are rotationally keyed to the shaft with elongated key element 37. The sleeve elements also form a bearing surface for impeller 41, which encircles the sleeve sections and is rotationally connected thereto through torque transmitting means 53. This is accomplished by securing one end portion of the flexible torque transmitting member 53 to a circumferential flange 38 extending from sleeve section 35 and securing the other end portion of the flexible torque transmitting member 53, hereinafter referred to as a bellows, to impeller section 41.

Like stationary impeller section 21, axially displaceable impeller section 41, as shown in FIGS. 1 and 2B, includes a central hub portion 42; a radial outer portion 48 containing impeller vanes 50 that cooperatively engage the impeller vanes 30 on the opposing impeller section 21; and an intermediate portion 45 which contains fluid directing deflectors 46 for conveying fluid from the upper housing inlet 14 to impeller vanes 50. Hub portion 42 includes a central aperture for receiving drive shaft 16 and a circumferential recess 43 for accomodating torque transmitting means 53. Fluid directing deflectors 46, which serve to support the outer portion 48 of impeller section 41 from hub portion 42, are shaped to direct fluid from housing inlet 14 to the impeller vane structure shown in FIG. 2B. Impeller vanes 50 have a section profile which is relatively thin adjacent hub portion 22 and which becomes thicker as the vanes extend radially therefrom.

Figure 3:
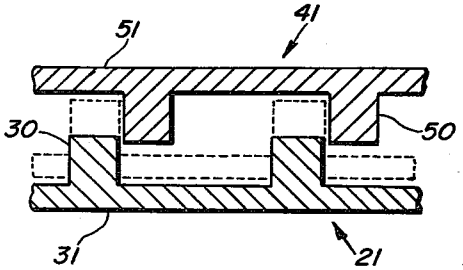
FIG. 3 is a sectional view illustrating the intermeshing relationship of the impellers of FIGS. 2A and 2B.

FIG. 3 depicts the intermeshing relationship of the impeller vanes 30,50 of respective impeller sections 21,41 in which the impeller sections are shown in their spaced apart position. Impeller vanes 30,50 are provided with a slight overlap in their spaced apart position to maintain the vanes in a predetermined rotational relationship and to preclude axial abrasion of the edge portions of the vanes. As the internal pump pressure on the rear surfaces 31,51 of impellers 21,41 increases, bellows 53 and spring element 24 contract to cause the axially displaced impeller section 41 to move toward impeller section 21 as shown in broken lines in FIG. 3.

Figure 5:
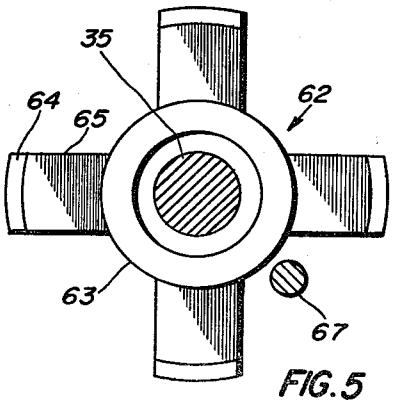
FIG. 5 is a front view of a disc element used to form a torque transmitting element.
Figure 4:
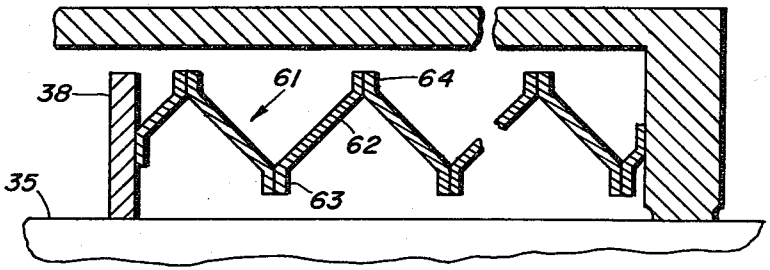
FIG. 4 is a partial sectional view of a torque transmitting element of the present invention.
Figure 6:
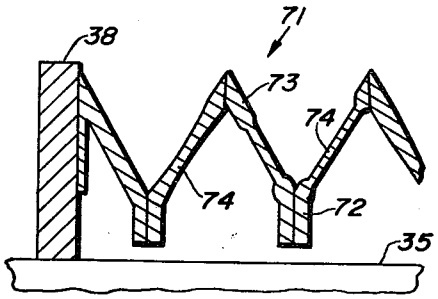

Torque transmitting means or bellows 53, which extends between circumferential flange 38 and hub portion 42, forms a flexible pressure responsive means for permitting axial displacement of impeller section 41 while precluding relative rotational displacements therebetween. This is accomplished by forming bellows 53 of rigid materials such as stainless steel, copper alloy or reinforced plastic and providing the bellows with a plurality of pleats to accomodate axial deformations thereof. For example, FIG. 4 depicts a sectional view of a particular bellows construction in which a bellows member 61 is formed of a plurality of dish-shaped discs 62 connected together in opposing relationship at the central 63 and peripheral edge 64 portions of the discs. As bellows member 61 is displaced (ie. compressed or stretched axially) from a neutral position, internal spring forces are produced that tend to return the bellows member 61 to the neutral position. FIG. 5 illustrates a modified form of disc structure in which pie-shaped portions of the discs 62 have been removed to leave radial flanges 65 that are connected to corresponding radial flanges on one of the adjacent disc elements. To prevent torsional "wind-up" of the bellows structure of FIG. 5, elongated guide elements 67 can be positioned within the cut-out portions of the disc elements. FIG. 6 depicts another bellows construction 71, similar to the bellows units of FIGS. 4 and 5, in which the circumferential flange portions 73 of the dish-shaped elements 72 are provided with zones 74 of reduced thickness. This arrangement provides a means for controlling the deformation (contraction/elongation) characteristics of the bellows for a predetermined pump load. Another means of correlating predetermined deformations of the bellows units with preselected pump loads consists of utilizing individual disc elements having different spring and deformation characteristics.

Figure 8:
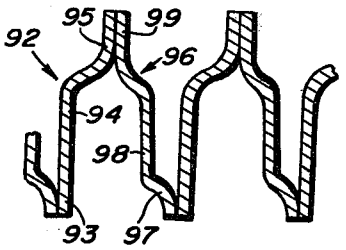
Figure 7:
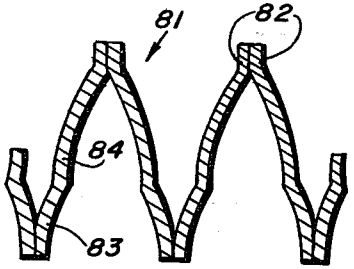

FIGS. 7 and 8 illustrate other bellows constructions in which the individual disc elements are joined together in opposing relationship. Bellows unit 81 of FIG. 7 is constructed of identical disc elements 82 which are provided with concave central portions 83 and concave flange portions 84 to increase the stiffness of selected portions of the disc elements so that axial deformation of bellows 81 initially occurs in flange portions 84. The bellows unit of FIG. 8 is formed of two dissimilar disc elements 92,96 which are joined together in opposing relationship at respective central portions 93,97 and peripheral flange portions 95,99. Flange portions 94,98 of disc elements 92,96 are formed with S-shaped regions that provide the bellows unit with radial and torsional stiffness while providing controlled flexure zones to accomodate axial deformation of the bellows of FIG. 8 under applied loads.

Figure 9:
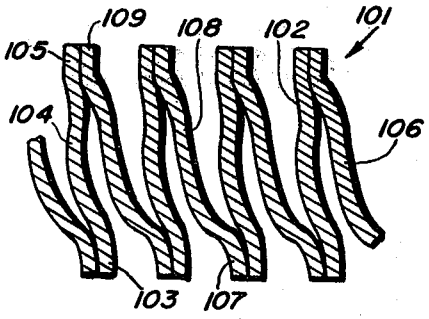

FIG. 9 depicts a bellows unit 101 of similar disc elements 102,106 which are joined together in nested relationship so that corresponding portions of the two disc elements curve in the same direction. For example, disc element 102 includes relatively flat central and outer portions 103,105, an arcuate flange portion 104, and S-shaped transition zones extending therebetween. Disc element 106 also includes relatively flat central and outer portions 107,109, an arcuate flange portion 108 of smaller radius of curvature than arcuate portion 104, and S-shaped transition zones extending between the disc portions.

Figure 10:
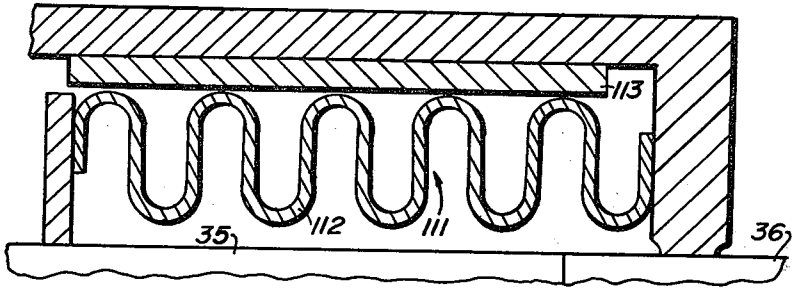
FIG. 10 is a sectional view of a torque transmitting element having convoluted surfaces.

The integral bellows unit 111 of FIG. 10 is preferably formed from a tube of a rigid material such as stainless steel and provided with a plurality of arcuate or sinusoidal-shaped pleats 112 designed to slide along antifriction guide elements 113 of fluorocarbon, bearing brass, or the like. The convoluted shape of bellows unit 111 provides a means for uniformly distributing localized applied stresses and for accomodating rapid axial displacements of impeller section 41.

Figure 11:
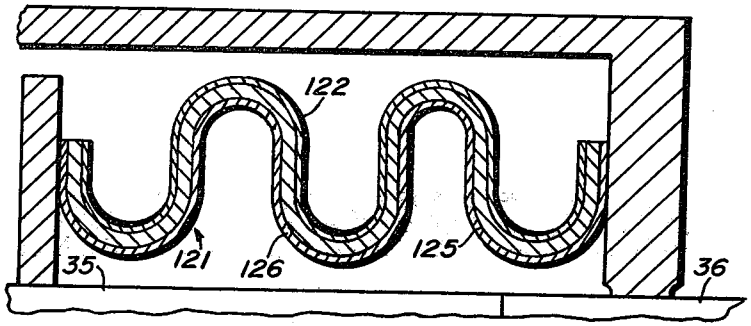
FIG. 11 is a sectional view of a composite torque transmitting element.

FIG. 11 illustrates another bellows structure 121 of concentrically arranged multilayered bellows elements 122,126 which are separated by a layer of elastomeric material 125. While the elastomeric material has little effect on the metal convolution portions in tension, it significantly reduces the "wind-up collapse" of the bellows unit 121 under compression loading. Additionally, the elastomeric layer 125 reduces and equalizes stress concentrations occurring in the bellows elements 122,126 and precludes metal-to-metal contact between adjacent bellows layers. Bellows elements 122,126 are preferably formed of stainless steel or nickel chromium steel, for example, with the thickness of the material dependent upon the pump capacity and the desired flexibility of bellows unit 121. To allow axial deformations of bellows unit 121, the spaced bellows elements 122,126 are arranged in phase with each other, with the grooves and ridges in nested, radial alignment.

During pump operation, spring element 24 and the fluid pressure between impeller sections 21,41 biases impeller sections 21,41 apart, and the fluid pressure acting on the rear impeller surfaces 31,51 and the spring force of the particular bellows element act to force the impellers together. Thus, for high demand conditions (ie. where water is being drawn off at a rapid rate) the fluid pressure on rear impeller surfaces 31,51 is relatively small and impeller sections 21,41 will spread apart. However, as the demand decreases (ie. the rate at which water is drawn off from the pump decreases) the fluid pressure on rear impeller surfaces 31,51 increases and impeller section 41 moves toward impeller section 21. Thus, depending upon the desired mode of operation, the pump 12 is capable of operation as a variable flow device at a constant operating pressure.

Obviously, many modifications and variations of the present invention are possible in light of the above teachings. It is therefore to be understood that within the scope of the appended claims, the invention may be practiced otherwise than as specifically described.

What is claimed is:

1. A variable geometry centrifugal pump comprising:

a housing having an inlet, an outlet, and a pump chamber formed therebetween;

a rotational shaft positioned within the pump chamber of the housing;

first and second spaced impellers having intermeshing vane portions disposed within the pump chamber and positioned around the shaft for rotational movements therewith, the first impeller is rotationally keyed to the shaft at a fixed axial position, and one of the impellers has central deflector ports for conveying fluid from the housing inlet to the region defined between the impellers; and flexible torque transmitting means interconnecting the first and second impellers for producing rotation of the second impeller in response to rotation of the first impeller and the shaft, and the torque transmitting means being capable of axial contraction and elongation in response to differential fluid pressure occurring on opposite surfaces of the impellers;

said flexible torque transmitting means comprising radially spaced concentric metal bellows elements having a plurality of pleated convolutions, said bellows elements are arranged so that the convolutions of each bellows are axially in phase, and a layer of elastomeric material disposed between the spaced bellows elements for reducing torsionally induced stresses within the bellows.

2. A variable geometry centrifugal pump comprising:

a housing having an inlet, an outlet, and a pump chamber formed therebetween;

a rotational shaft positioned within the pump chamber of the housing;

first and second spaced impellers having intermeshing vane portions disposed within the pump chamber and positioned around the shaft for rotational movements therewith, the first impeller is rotationally keyed to the shaft at a fixed axial position, and one of the impellers has central deflector ports for conveying fluid from the housing inlet to the region defined between the impellers; and flexible torque transmitting means interconnecting the first and second impellers for producing rotation of the second impeller in response to rotation of the first impeller and the shaft, and the torque transmitting means being capable of axial contraction and elongation in response to differential fluid pressure occurring on opposite surfaces of the impellers;

said flexible torque transmitting means comprising radially spaced concentric resilient bellows elements having corrugated surfaces of alternating ridges and grooves, said bellows elements are arranged so that the projecting ridges of a radially inner bellows are received within the radially inwardly opening grooves of an outer bellows; and a layer of elastomeric material disposed between the spaced elements for distributing torsionally induced stresses within the bellows.

3. A variable geometry centrifugal pump comprising:

a housing having an inlet, an outlet, and a pump chamber formed therebetween;

a rotational shaft positioned within the pump chamber of the housing;

first and second spaced impellers having intermeshing vane portions disposed within the pump chamber and positioned around the shaft for rotational movements therewith, the first impeller is rotationally keyed to the shaft at a fixed axial position, and one of the impellers has central deflector ports for conveying fluid from the housing inlet to the region defined between the impellers; and flexible torque transmitting means interconnecting the first and second impellers for producing rotation of the second impeller in response to rotation of the first impeller and the shaft, and the torque transmitting means being capable of axial contraction and elongation in response to differential fluid pressure occurring on opposite surfaces of the impellers;

said flexible torque transmitting means comprising a resilient bellows formed of a plurality of axially aligned, interconnected dish-shaped disc elements; each disc element includes a central portion provided with an aperture, a circumferential peripheral edge portion, and a flange portion extending therebetween; and the disc elements are connected together so that the central portion of one disc element is connected to the central portion of the adjacent disc element on one side of said disc element and the peripheral edge portion of said one disc element is connected to the peripheral edge portion of the disc element on the opposite side of said disc element.

4. The pump according to claim 3, wherein sections of the disc elements have been removed so that the flange and peripheral portions of the disc elements define elongated radial projections extending from the central portion.

5. The pump according to claim 4, further comprising:

elongated guide means positioned between the radial projections of the axially aligned disc elements to preclude torsional displacement of the disc elements.

6. The pump according to claim 4, wherein the flange portions are provided with bent portions to provide axial and torsional stiffness to the disc elements.

7. The pump according to claim 3, wherein the disc elements are arranged in an alternating pattern of first and second disc elements, the first disc element has a flat flange portion with an S-shaped curved portion extending between the flange and peripheral portions, and the second disc element has a flat flange portion with S-shaped curved portions extending between the central and flange portions.

8. The pump according to claim 3, wherein the disc elements are arranged in an alternating pattern of first and second disc elements, the first and second disc elements have arcuate flange portions, and the arcuate flange portion of the first disc element has a different curvature than the arcuate flange portion of the second disc element.

* * * * *